US009423107B2

(12) United States Patent
Glover

(10) Patent No.: US 9,423,107 B2
(45) Date of Patent: Aug. 23, 2016

(54) MOLDED LIGHT STRAND

(71) Applicant: Joshua Dean Glover, Bristol, TN (US)

(72) Inventor: Joshua Dean Glover, Bristol, TN (US)

( * ) Notice: Subject to any disclaimer, the term of this patent is extended or adjusted under 35 U.S.C. 154(b) by 0 days.

(21) Appl. No.: 14/686,276

(22) Filed: Apr. 14, 2015

(65) Prior Publication Data

US 2015/0311657 A1 Oct. 29, 2015

Related U.S. Application Data

(60) Provisional application No. 61/983,245, filed on Apr. 23, 2014.

(51) Int. Cl.

| | |
|---|---|
| ***H01R 4/24*** | (2006.01) |
| ***F21V 19/00*** | (2006.01) |
| *F21V 21/088* | (2006.01) |

(52) U.S. Cl.

CPC . *F21V 19/00* (2013.01); *F21S 4/10* (2016.01); *F21V 21/088* (2013.01); *H01R 4/2404* (2013.01)

(58) Field of Classification Search

CPC ..... H01R 13/523; H01R 13/5227; H01R 33/9651; H01R 33/22; H01R 4/2433; H01R 23/025; H01R 4/2404; F21S 4/001; F21Y 2101/02; F21V 21/30

USPC ..... 439/205, 206, 280, 340, 417, 418, 419; 362/391, 249.01, 249.02, 249.06, 362/249.1

See application file for complete search history.

(56) References Cited

U.S. PATENT DOCUMENTS

| | | | | |
|---|---|---|---|---|
| 3,335,389 | A * | 8/1967 | Reichardt | H01R 33/92 313/271 |
| 5,556,298 | A * | 9/1996 | Huang | H01R 4/2404 439/419 |
| 5,584,567 | A * | 12/1996 | Rumpel | A47G 33/105 248/229.16 |
| 5,722,853 | A | 3/1998 | Hwang | |
| 5,820,419 | A * | 10/1998 | Liao | H01R 33/965 439/280 |
| 5,967,823 | A * | 10/1999 | Tsui | F21S 4/001 439/280 |
| 5,980,304 | A * | 11/1999 | Lin | F21V 21/002 439/188 |
| 6,010,346 | A * | 1/2000 | Wang | F21V 21/002 439/206 |
| 6,039,593 | A * | 3/2000 | Chen | H01R 33/965 439/280 |
| 6,116,944 | A * | 9/2000 | Tseng | H01R 4/2404 439/419 |
| 6,241,552 | B1 * | 6/2001 | Pan | F21S 4/002 439/575 |
| 6,328,593 | B1 * | 12/2001 | Chang | F21S 4/001 362/249.01 |
| 7,217,012 | B2 * | 5/2007 | Southard | G09F 9/33 362/240 |
| 7,399,105 | B2 * | 7/2008 | Southard | G09F 9/33 362/240 |

* cited by examiner

*Primary Examiner* — Thanh Tam Le
(74) *Attorney, Agent, or Firm* — Pitts & Lake, P.C.

(57) ABSTRACT

An electric light strand is disclosed which comprises a cable comprising at least one wire, and a plurality of sockets secured to the cable. Each socket defines an internal cavity for receiving a sleeve portion a light bulb. Each internal cavity defines a central axis. Each socket comprises a plurality of contacts configured to provide electrical communication between the at least one wire and a corresponding one of the sleeve portions. Each central axis extends in an orientation non-perpendicular to a corresponding portion of the cable secured to the corresponding socket.

2 Claims, 3 Drawing Sheets

MOLDED LIGHT STRAND

CROSS-REFERENCE TO RELATED APPLICATIONS

This application claims the benefit of U.S. Provisional Patent Application No. 61/983,245, filed on Apr. 23, 2015, incorporated in its entirety herein by reference.

STATEMENT REGARDING FEDERALLY-SPONSORED RESEARCH OR DEVELOPMENT

Not Applicable

BACKGROUND OF THE INVENTION

1. Field of Invention

The present general inventive concept relates to lighting, and more specifically, to a light strand having a plurality of spaced apart light sockets which extend along a length of the strand to orient light bulbs received within the sockets along the strand.

2. Description of the Related Art

Electric light strands of the type commonly used in indoor and outdoor decorative lighting, such as for example in Christmas and other holiday decorations, are generally known in the art. Such light strands typically include a plurality of light sockets which are disposed along, and are in electrical communication with, an electrical cable comprising one or more electrical wires. Each socket is adapted to receive and engage a sleeve portion of a light bulb, and includes suitable conductor plates for establishing electrical communication between the electrical contacts of the light bulb and the electrical wires forming the cable.

In several common designs for electric light strands, each of the sockets of the strand is secured to the cable in such a way that, when the cable is extended along a linear orientation, central axes of the sockets, and the light bulbs received therein, extend generally orthogonally to the linear direction of the cable. For example, in several designs of electric light strands, each socket defines a generally cylindrical shape and includes an open axial end for receiving a light bulb sleeve within the socket, and a closed axial end opposite thereto. In certain designs, one or more wires of the cable are received within suitable openings in the closed axial end of the socket, which extend generally parallel to an axial dimension of the socket, to establish electrical communication between the electric plates of the socket and the cable. In other designs, such as for example the C-type bulb socket described and shown in U.S. Pat. No. 5,722,853, issued to Hwang on Mar. 3, 1998, one or more of the wires of the cable extends inwardly and outwardly of the socket through the curved sidewall of the cylindrical socket, such that the cable is oriented generally perpendicular to the axial dimension of the socket. In both designs, the end result is an electric light strand in which the axial dimension of the socket extends generally orthogonally to the cable when the cable is extended along a linear dimension.

In use of light strands of the type described above, difficulty arises in mounting the light strand in such a way that the light sources produced by the various light sockets and corresponding light bulbs are held in a relatively straight line in relation to one another. Specifically, it is recognized that, although each of the light sockets of the light strands described above extends generally perpendicular to the cable when the cable is stretched along a linear dimension, the light sockets do not necessarily extend in the same direction relative to one another. Thus, when the light strand is mounted in a linear configuration, for example against a flat surface, it is possible that some sockets may extend to one side of the cable along the surface, other sockets may extend to the other side of the cable along the surface, and still other sockets may extend outwardly from the surface.

In several applications of electric light strands, it is desirable to mount the light strand in such a way that the light sources produced by the various light sockets and corresponding light bulbs are held in a relatively straight line in relation to one another. Accordingly, an improved electric light strand that addresses the above-discussed limitations is desired.

DESCRIPTION OF THE DRAWINGS

The above-mentioned features of the invention will become more clearly understood from the following detailed description of the invention read together with the drawings in which.

DESCRIPTION OF THE INVENTION

Figure 1:
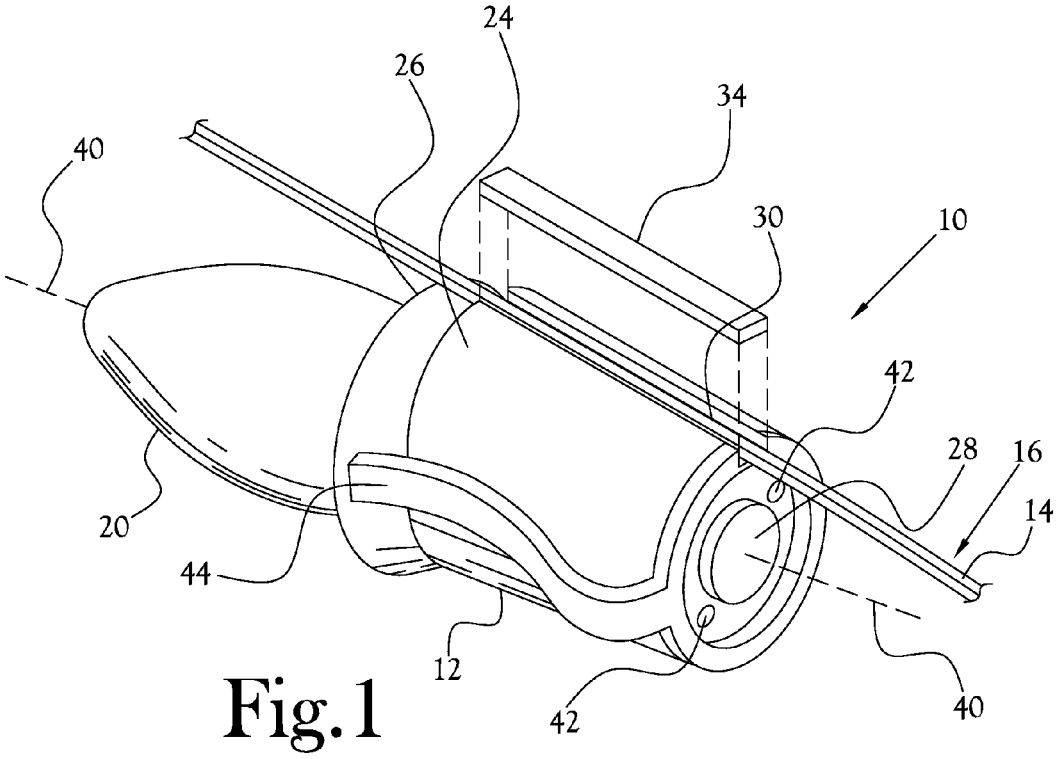
FIG. 1 is a perspective view showing one embodiment of a molded light strand constructed in accordance with several features of the present general inventive concept.
Figure 2:
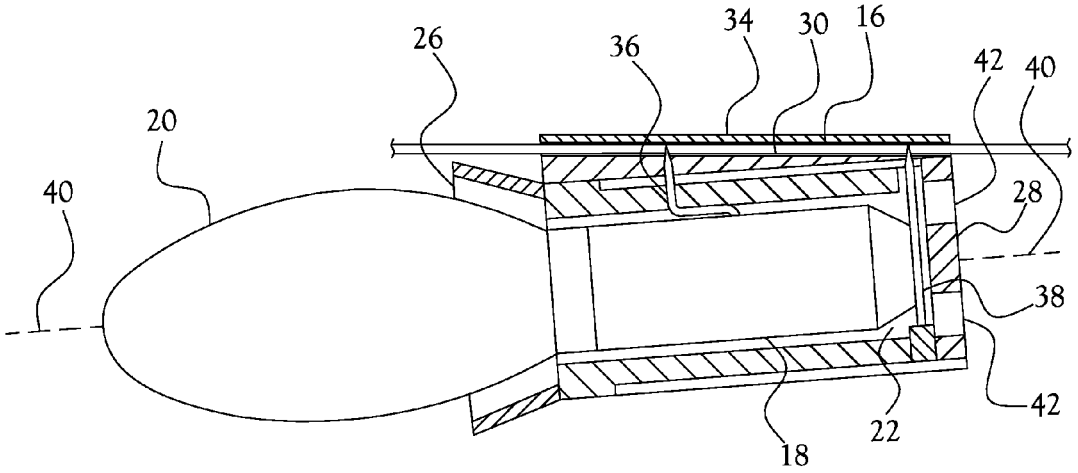
FIG. 2 is a cross-sectional side view showing another embodiment of a molded light strand constructed in accordance with several features of the present general inventive concept.
Figure 3:
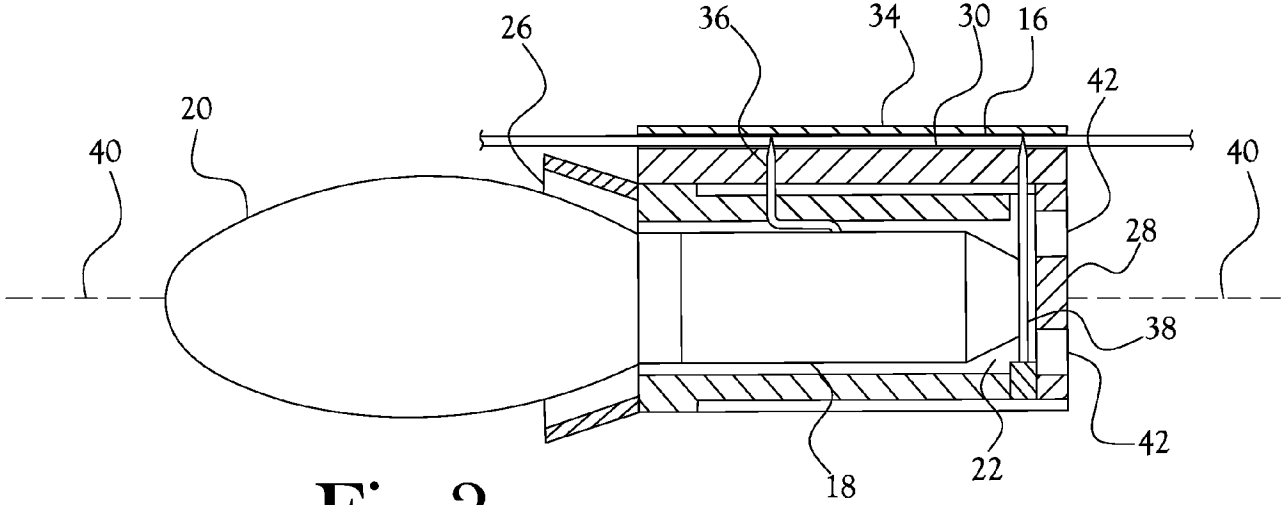
FIG. 3 is a cross-sectional side view showing another embodiment of a molded light strand constructed in accordance with several features of the present general inventive concept.
Figure 4:
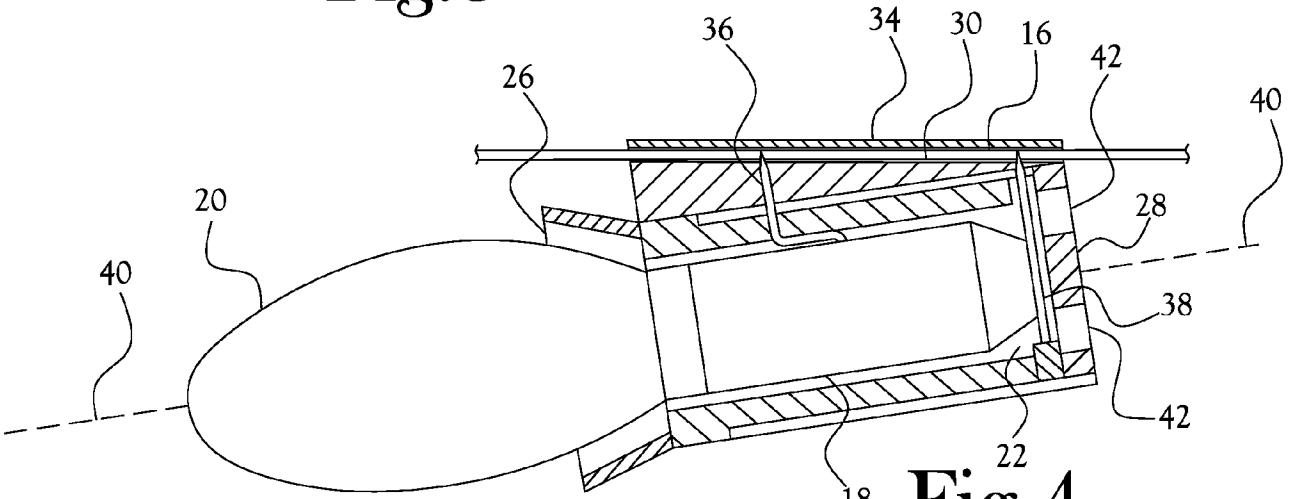
FIG. 4 is a cross-sectional side view showing another embodiment of a molded light strand constructed in accordance with several features of the present general inventive concept.
Figure 5:
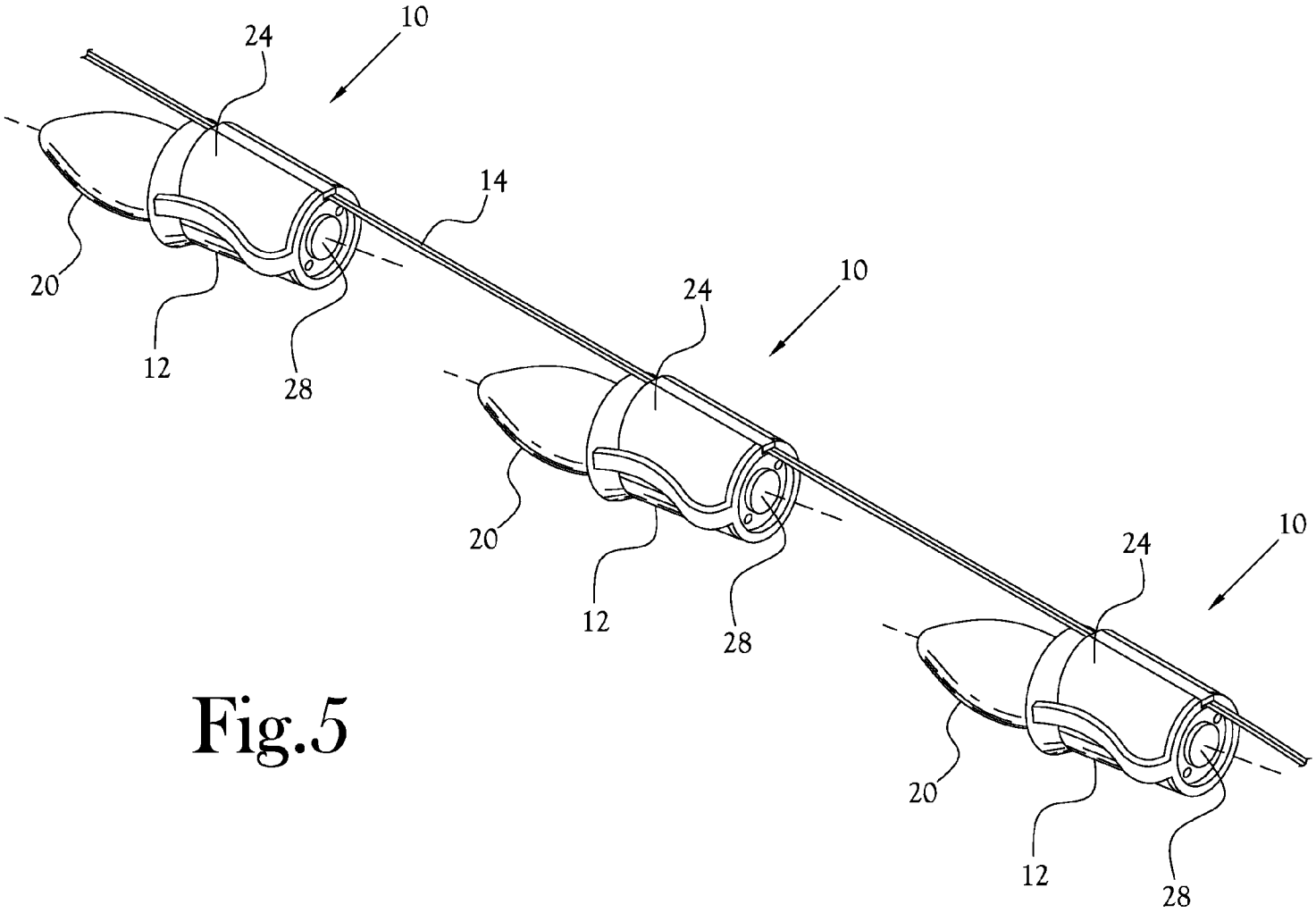
FIG. 5 is a perspective view of the embodiment of the molded light strand of FIG. 1.

Reference will now be made to various example embodiments of the present general inventive concept, examples of which are illustrated in the accompanying drawings and illustrations. The example embodiments are described herein in order to explain the present general inventive concept by referring to the figures. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art.

In accordance with various example embodiments of the present general inventive concept, a molded light strand is described herein and in the accompanying figures. The molded light strand, or "strand," is illustrated generally at 10 in the figures and includes a plurality of sockets 12 in electrical communication with one or more wires 14 forming a cable 16. Each of the sockets 12 is configured to receive a sleeve portion 18 of a light bulb 20 therein and to place the sleeve 18 in electrical communication with the at least one wire 14 of the cable 16. As will be further described hereinbelow, each socket 12 is disposed in an orientation along the cable 16 such that a corresponding light bulb 20 extends from the socket at least relatively close to, and in some embodiments adjacent to, the cable.

FIG. 1 illustrates one embodiment of a strand 10 according to several features of the present general inventive concept. As shown in FIG. 1, in one embodiment, the strand 10 includes at least one socket 12 which defines a generally cylindrical, or slightly flared truncated conical, external shape, having a circumferential side wall 24, a slightly flared, open first end 26, and a closed second end 28. The open first end 26 provides access to an internal cavity 22 of the socket 12 which is sized and shaped to receive a sleeve portion 18 of a light bulb 20. In the illustrated embodiment, the internal cavity 22 of the socket 12 is sized to receive a sleeve portion of a C-type light bulb of the type known in the art. However, it will be recognized that the socket 12 can be sized to accommodate any of numerous types of light bulbs without departing from the spirit and scope of the present general inventive concept.

In the illustrated embodiment, the side wall 24 of the socket 12 defines an elongated channel 30 extending generally along an axial dimension 40 of the socket 12. The channel 30 is generally sized and shaped to receive therein a portion of the cable 16. A cap 34 is provided which is shaped to mate with and engage at least a portion of the channel 30 in overlying relationship with the portion of the cable 16 received within the channel 30 to secure the portion of the cable 16 within the channel 30. Thus, by placing a portion of the cable 16 within the channel 30 and then securing the cap 34 in mating engagement with the channel 30, the socket 12 may be secured at a location along the length of the cable 16.

In several embodiments, a plurality of contacts 36, 38 are disposed within the socket 12 and in communication with the channel 30, such that the contacts 36, 38 may establish electrical communication between the sleeve 18 of a light bulb 20 received within the socket 12 and at least one wire 14 of the cable 16. For example, in the illustrated embodiment, a first contact 36 extends along an interior of the side wall 24 of the socket 12 and projects outwardly through the side wall 24 and into the channel 30. A second contact 38 extends along an interior surface of the closed end 28 of the socket 12 and projects outwardly into the channel 30 through an interface of the side wall 24 and the closed end 28. Thus, when a light bulb sleeve 18 is received within the socket 12, the first contact 36 is brought into engagement with a side wall of the sleeve 18, while the second contact 38 is brought into engagement with an end portion of the sleeve 18. In the illustrated embodiment in which a C-type light bulb is employed, it will be recognized that such configuration of the contacts 36, 38 serves to provide electrical communication between the contacts 36, 38 and the operative portions of the sleeve 18 necessary to allow electrical current to flow through the filament of the light bulb 20 when such current is introduced to the contacts 36, 38. However, it will be recognized that numerous other configurations are possible for arrangement of the portions of the contacts 36, 38 within the interior of the socket 12 to allow the contacts 36, 38 to operatively engage light bulbs of different designs, and such other configurations may be used without departing from the spirit and scope of the present general inventive concept.

Numerous suitable devices and configurations exist which may be used for establishing electrical communication between the electrical contacts 36, 38 and the at least one wire 14 of the cable. For example, in the illustrated embodiment, each of the portions of the electrical contacts 36, 38 extending into the channel 30 defines a pointed shape, the point extending generally outwardly from the side wall 24 of the socket 12 and toward the cap 34. Thus, when a portion of the cable 16 is placed into the channel 30 and the cap 34 is placed in engagement with the channel 30, the points of the electrical contacts 36, 38 are compressed into the exterior of the cable 16, thereby establishing electrical engagement between the contacts 36, 38, and the at least one wire 14. In embodiments in which an insulative sheathing surrounds the at least one wire 14 of the cable 16, the points of the contacts 36, 38 may puncture the sheathing and access the at least one wire 14 beneath the sheathing.

It will be appreciated that, with the channel 30 extending along the side wall 24 of the socket 12 and the cable 16 received therein, a central axis 40 of the internal cavity 22 of the socket 12, and of the corresponding light bulb 20 received therein, extends in a non-perpendicular orientation to the long dimension of the portion of the cable 16 received within the channel 30. In several embodiments, the channel 30 and corresponding portion of cable 16 received therein extend parallel to, or almost parallel to, the central axis 40 of the socket 12 and bulb 20. Thus, it will be appreciated that the light bulb 20 is generally held by the socket 12 in close proximity to the cable 16, such that when the cable 16 is mounted along a generally linear orientation, each of the light bulbs 20 received within various sockets 12 of the strand 10 are generally held in a linear orientation to one another, absent any further arrangement or additional fastening of the individual sockets 12 in relation to the cable 16 or the structure on which the cable 16 is mounted.

In different embodiments constructed in accordance with the present general inventive concept, the specific angular orientation of the channel 30 in relation to the central axis 40 of the socket cavity 22 and bulb 20 may vary, for example in order to allow for slight separation between the light bulb 20 and the cable 16, and/or to limit heat transfer between the light bulb 20 and the cable 16. For example, in the illustrated embodiment, the channel 30 extends along the entire length of the side wall 24 of the socket 12. Thus, the angular orientation of the channel 30 in relation to the central axis 40 of the socket cavity 22 and bulb 20 substantially matches the angular orientation between the exterior of the side wall 24 of the socket 12 and the central axis 40 of the socket cavity 22 and bulb 20. In other embodiments, the channel 30 may extend along only a portion of the side wall 24, or may vary in depth along the side wall 24, such that the angular orientation of the channel 30 in relation to the central axis 40 varies from that of the external surface of the socket 12. In still other embodiments, the external surface of the side wall 24 may define truncated conical shapes having varying degrees of slant, such that the angle of the channel 30 in relation to the central axis 40 may vary.

Optionally, the socket 12 may further include one or more drain holes 42 which may allow water or other fluid accumulated within the socket internal cavity 22 to drain from the socket 12. Thus, in applications in which the strand 10 is employed in an outdoor setting, the drain holes 42 may reduce the likelihood of electrical shortage within the socket 12 due to moisture or other conductive fluid accumulating therein. Furthermore, in certain embodiments, the socket 12 may define one or more clips 44 extending along an exterior surface of the socket 12 to assist a user in mounting the strand 10 to a desired location, such as for example on an edge of a surface, length of cordage, etc. However, it will be recognized that inclusion of the drain holes 42 and/or clip 44 is not necessary to accomplish the strand 10 in accordance with the present general inventive concept.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. An electric light strand comprising:

a cable comprising at least one wire;

a plurality of sockets secured to said cable, each socket defining an internal cavity for receiving a sleeve portion of a light bulb, each said internal cavity defining a central axis, each socket comprising a plurality of contacts configured to provide electrical communication between said at least one wire and a corresponding one of said sleeve portions, each said socket defining an open first end, a closed second end, and a side wall extending there between, each said socket side wall defining a channel extending along said side wall and along said central axis, each said channel having a portion of said cable received therein each said socket further comprising a cap configured to mate with and engage said channel to secure said portion of said cable to said socket; and wherein each said central axis extends in an orientation non-perpendicular to a corresponding portion of said cable secured to said corresponding socket.

2. The electric light strand of claim 1, each said contact having a portion thereof extending into said internal cavity and a portion thereof extending into said channel to engage at least one wire of said cable.

* * * * *